US005138588A

United States Patent [19]

Chuan et al.

[11] Patent Number: 5,138,588

[45] Date of Patent: Aug. 11, 1992

[54] UNDERWATER SOUND ATTENUATOR

[75] Inventors: Raymond L. Chuan, Huntington Beach; Houston Chen, Santa Ana, both of Calif.

[73] Assignee: Brunswick Corporation, Skokie, Ill.

[21] Appl. No.: 684,512

[22] Filed: Apr. 15, 1991

Related U.S. Application Data

[63] Continuation of Ser. No. 234,148, Aug. 19, 1988, abandoned.

[51] Int. Cl.[5] ..... H04R 17/00

[52] U.S. Cl. ..... 367/176; 181/286; 367/153

[58] Field of Search ..... 181/0.5, 122, 151, 198, 181/210, 211, 258, 264, 286, 288, 279, 290, 292, 400, 401, 402; 367/1, 151, 162, 165, 166, 171, 173, 176, 188, 191, 141, 153

[56] References Cited

U.S. PATENT DOCUMENTS

| | | | |
|---|---|---|---|
| 2,415,832 | 2/1947 | Mason | 367/162 |
| 2,789,280 | 4/1957 | Harris | 181/290 |
| 2,811,216 | 10/1957 | Harris | 367/1 |
| 3,018,465 | 1/1962 | Harris | 367/152 |
| 3,241,099 | 3/1966 | Elston et al. | 367/141 |
| 3,264,605 | 8/1966 | Vincent | 367/191 |
| 3,907,062 | 9/1975 | Brigham et al. | 181/0.5 |
| 4,140,992 | 2/1979 | Wardle | 367/153 |
| 4,158,189 | 6/1979 | Wardle | 367/153 |
| 4,184,093 | 1/1980 | Sullivan | 310/800 |
| 4,188,609 | 2/1980 | Mott | 367/140 |
| 4,386,676 | 6/1983 | Gadde et al. | 340/140 |
| 4,395,908 | 8/1983 | Shopland | 367/163 X |
| 4,399,526 | 8/1983 | Eynck | 367/153 X |
| 4,439,497 | 3/1984 | Diffogio | 181/207 |
| 4,450,544 | 5/1984 | Denaro et al. | 367/176 |
| 4,532,450 | 7/1985 | McNeel et al. | 310/331 X |
| 4,536,862 | 8/1985 | Sullivan et al. | 367/153 |
| 4,669,573 | 6/1987 | Goodman | 181/286 |
| 4,759,000 | 7/1988 | Reitz | 367/176 |
| 4,815,050 | 3/1989 | Kurz | 367/176 |
| 4,821,243 | 4/1989 | Caprette, Jr. | 367/151 X |
| 4,887,247 | 12/1989 | Black et al. | 367/151 |

OTHER PUBLICATIONS 3 listings of references cited during prosecution of U.S. patent application Ser. No. 739, 513, filed May 31, 1985.

*Primary Examiner*—Brian S. Steinberger

*Attorney, Agent, or Firm*—Finnegan, Henderson, Farabow, Garrett and Dunner

[57] ABSTRACT

An apparatus for preventing the transmission of sound in an underwater medium. A resilient housing encloses at least two voids. A first void contains a compliant tube consisting of two T-shaped support structures, each T-shaped support structure supporting a free-bending span designed to resonate at a predetermined frequency. A second void contains a viscous liquid in which metal fibers are suspended. The resilient housing may be surrounded by a rigid cover material which may include means for fastening the apparatus to a surface. The viscous liquid dissipates sound. The compliant tube attenuates the sound waves and decreases the velocity of the sound waves, consequently decreasing the wavelength of the waves.

24 Claims, 4 Drawing Sheets

UNDERWATER SOUND ATTENUATOR

This application is a continuation of application Ser. No. 07/234,148 filed Aug. 19, 1988 now abandoned.

BACKGROUND OF THE INVENTION

1. Field of the Invention

This invention is related to an apparatus for preventing the transmission of sound in a medium, and in particular a sound attenuator capable of attenuating low frequency sound in a hydrostatic pressure environment.

2. The Prior Art

A basic method of preventing the transmission of sound in a medium requires the introduction of a significant density discontinuity in the medium. For example, sound attenuation in a low density medium requires the introduction of a high density material, such as a slab of steel, to create a high density discontinuity in the low density medium. Similarly, in a high density medium, sound attenuation can be achieved by introducing a low density material, such as air, to create a low density discontinuity in the high density medium. Thus, a water/air interface would serve as an effective sound attenuator in water.

A captive arrangement of air bubbles can serve as a sound attenuator in a water medium. To be effective, the hydrostatic water pressure of a medium must not exceed the pressure required to collapse the bubbles. A layer of rubber containing air cavities has been used successfully as a sound attenuator in a water medium at hydrostatic pressures less than approximately 150 pounds per square inch (psi). Such sound attenuators are commonly referred to as air-rubber baffles.

An enclosure stiffer than rubber is required to attenuate sound in a water environment at pressures higher than 150 psi. At such pressures, the air bubbles would collapse and, thus, no sound would be attenuated. Enclosures stiff enough to withstand high levels of hydrostatic pressure should at the same time offer little or no resistance to sound pressure. Thus, if a stiff enclosure is constructed to exhibit resonant vibrations (with accompanying changes of the enclosed volume) at prescribed frequencies, the enclosure in effect becomes "soft" in the presence of sound pressure fluctuations at these prescribed frequencies. In other words, the enclosure is statically "stiff" but dynamically "soft." The vibration of the stiff enclosure absorbs the sound energy at the resonant frequency, but does not transmit this energy through the low density space inside the enclosure. An enclosure so designed thus acts as an efficient barrier against sound propagation at the prescribed resonant frequencies and therefore is considered a "tuned resonant baffle," commonly referred to as a "compliant tube baffle."

A conventional compliant tube is essentially a tube of near oval cross section whose long sides vibrate as plates and whose curved edges function as built-in nodes of vibration. Examples of conventional compliant tubes are shown in U.S. Pat. Nos. 3,264,605 and 3,907,062, the disclosures of which are hereby incorporated herein by reference. Such conventional compliant tubes are limited in their ability to attentuate relatively low frequency sound in a hydrostatic pressure environment. As explained in U.S. Pat. No. 3,264,605, as increasing pressure is exerted on the tube, the long walls of the tube bend toward the middle, and the curved or convex edges are drawn into a smaller arc. Thus, the pressure exerted on the tube forces the curved or convex edges into a smaller arc. The stress on the curved or convex edges increases with increasing pressure. Eventually, the pressure increases to a value that causes the tube to rupture and renders the tube useless.

The maximum static pressure which the tube is capable of withstanding can be increased by making the curved edges thicker. However, increasing the thickness of the tube wall at the edges results in two disadvantages: increased weight and an increase in the tuned frequency of the tube. Extra weight is undesirable in submarine applications such as the application disclosed in U.S. Pat. No. 3,907,062. The greater thickness of the tube wall also precludes the attenuation of low frequencies (i.e., less than 1000 Hz) because the frequencies below which attentuation does not occur increase with increasing wall thickness. Thus, thickening the tube walls is not an acceptable solution in applications requiring attenuation of lower frequencies in hydrostatic pressure environments.

The solution of U.S. Pat. No. 3,264,605 of introducing a relatively noncompressiole fluid inside the tube is marginally effective to prevent rupturing of the tube at higher pressures than the tubes could withstand without the presence of the noncompressible fluid. However, in some applications, the added weight of the noncompressible fluid is as equally undesirable as is the weight added by the increased thickness of the tube wall. Moreover, the frequencies capable of being attenuated by the tube containing a noncompressible fluid are relatively higher than frequencies capable of being attenuated by a hollow tube which is similar in all respects except for the presence of the noncompressible fluid.

SUMMARY OF THE INVENTION

The present invention overcomes the problems and disadvantages of the prior art by providing both a sound attenuating and a sound dissipating structure and by enclosing these structures in a resilient housing.

It is a principal object of the present invention to provide an apparatus which prevents the transmission of low frequency sound in a hydrostatic pressure environment and yet is relatively lighter in weight than conventional apparatus and capable of withstanding higher static pressures.

Another object of the present invention is to provide such an apparatus which can attenuate sound frequencies below 1000 Hz.

Additional objects and advantages of the invention will be set forth in part in the description which follows and, in part, will be obvious from the description or may be learned by the practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus for attenuating low frequency sound striking a submerged surface comprises a resilient housing having first and second voids therein. A pair of free-bending spans is disposed in the first void and spaced a pre-selected distance opposite each other during an unflexed state. Each of the pair of spans has peripheral edges substantially aligned with the peripheral edges of the other of the pair, with means supporting the spans adjacent their peripheral edges. Fluid means is disposed in the second void for dissipating sound waves striking the resilient housing.

The accompanying drawings, which are incorporated in and constitute a part of this specification, illustrate specific embodiments of the invention and, together with the description, serve to explain the principles of the invention.

DESCRIPTION OF THE PREFERRED EMBODIMENTS

Figure 1:
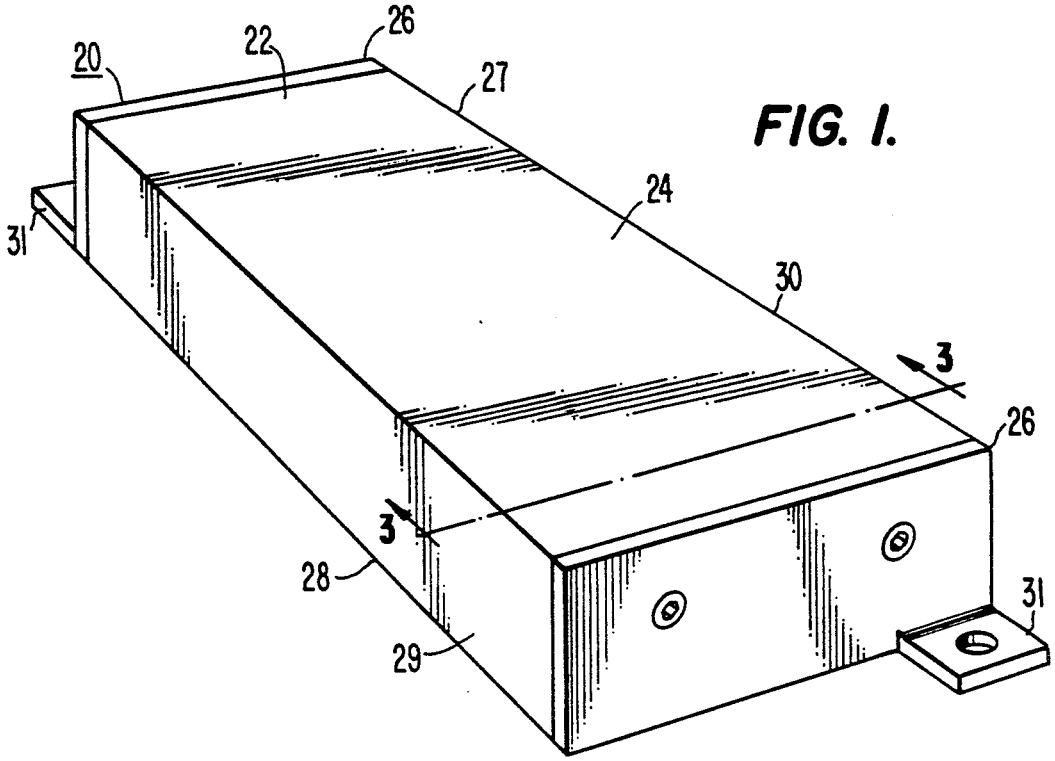
FIG. 1 is a view in perspective of a first embodiment of a sound attenuator incorporating the teachings of the present invention.

Reference will now be made in detail to several present preferred embodiments of this invention, examples of which are illustrated in the accompanying drawings. Wherever possible, the same reference numbers will be used throughout the drawings to refer to the same or like parts.

An apparatus for attenuating low frequency sound striking a submerged surface is shown in FIGS. 1–8.

In accordance with the present invention, the apparatus comprises a resilient housing having first and second voids therein. As embodied in FIGS. 1 and 2, an apparatus 20 comprises a resilient housing 22 having a resilient portion 24 and two rigid end portions 26. Resilient portion 24, which is rectangular in cross section and has top portion 27, bottom portion 28, and two side portions 29 and 30, is preferably composed of elastomeric material compatible with seawater and having low tensile and shear modulii and a specific gravity close to that of water, so that external acoustic pressures are transmitted to the interior of apparatus 20 without excessive reflection. Suitable materials for resilient portion 24 are elastomers such as castable polyurethane polymer, Lamaca (a proprietary elastomer formulation of Brunswick Corporation), and moldable nitrile rubber compounds. Rigid end portions 26 may be composed of material such as steel, fiberglass, or glass reinforced plastic and have an integral flange 31 for fastening to an underwater object. Rigid end portions 26 are attached to apparatus 20 by bonding during the manufacturing process. Although the embodiment of FIGS. 1 and 2, preferably has two rigid end portions 26 having an integral flange 31, it is understood that one or both rigid end portions 26 may be formed without flange 31.

Figure 2:
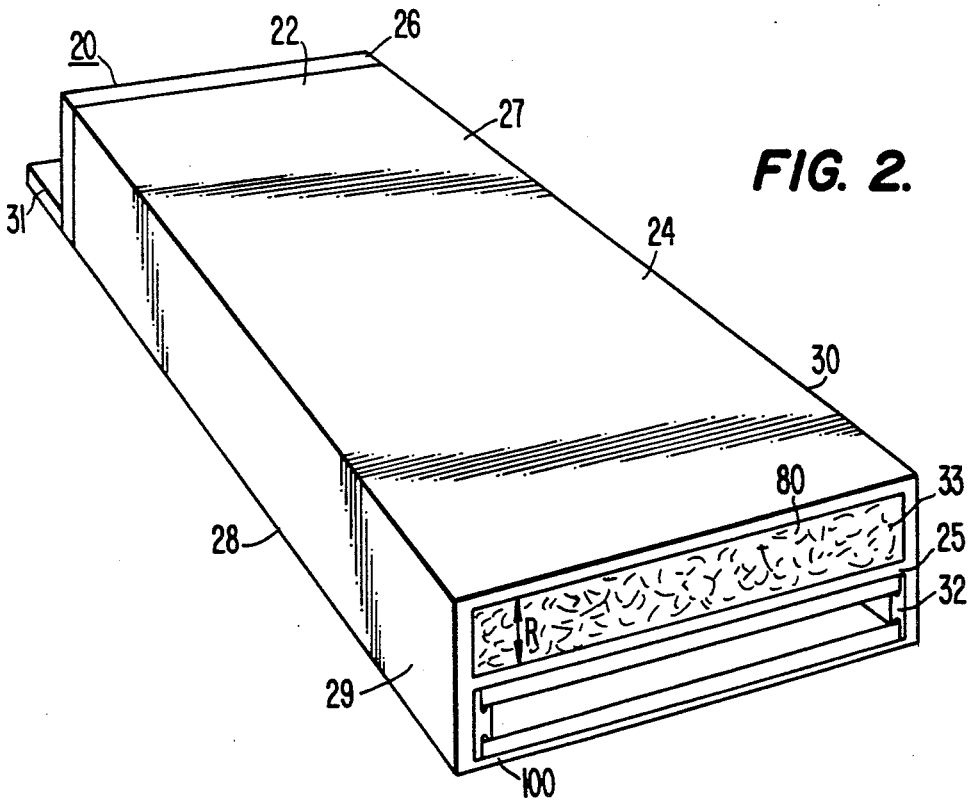
FIG. 2 is a view in perspective of the sound attenuator of FIG. 1 along line 3—3 of FIG. 1 to show the interior thereof.

As shown in FIG. 2, resilient housing 22 has a first rectangular void 32 and a second rectangular void 33. As also shown in FIG. 2, resilient portion 24 includes a wall or septum 25 for separating first void 32 from second void 33, which extends substantially perpendicular to side portions 29 and 30 and substantially parallel to top portion 27 and bottom portion 28. First void 32 is defined by wall or septum 25, side portions 29 and 30, bottom portion 28, and by two rigid end portions 26. Similarly, second void 33 is defined by wall or septum 25, side portions 29 and 30, top portion 27, and by two rigid end portions 26.

Figure 3:
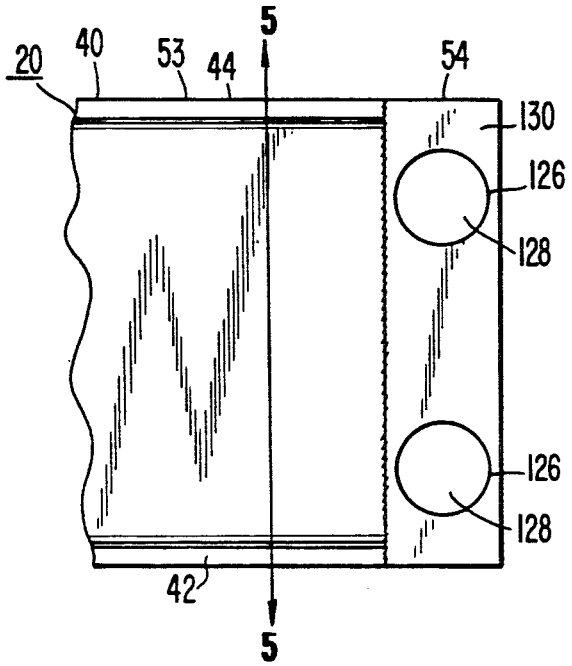
FIG. 3 is a fragmentary plan view of a second embodiment of an attenuator incorporating the teachings of the present invention.
Figure 4:
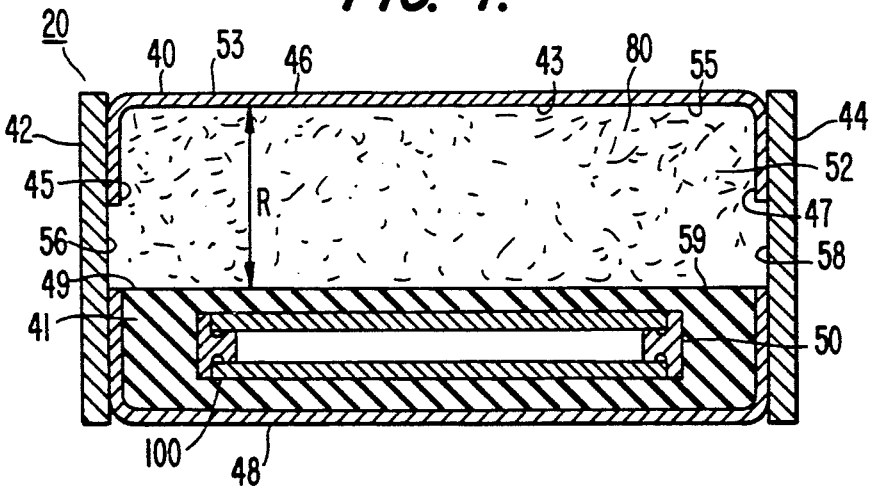
FIG. 4 is a cross-sectional view of the second embodiment taken at line 5—5 of FIG. 3.
Figure 5:
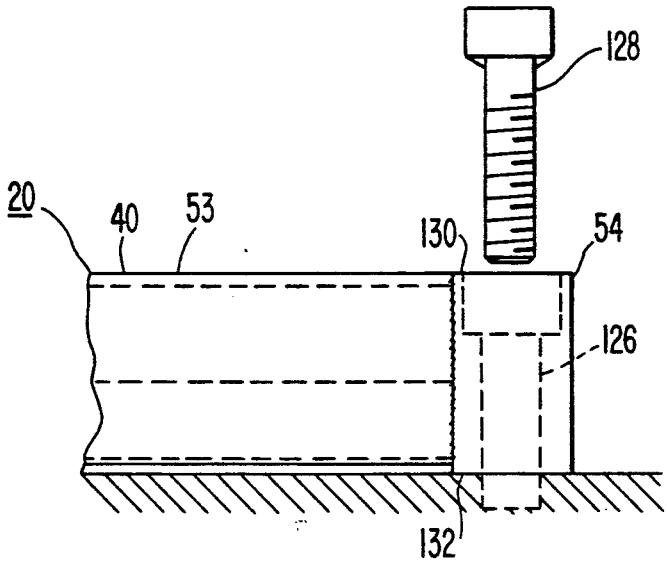
FIG. 5 is a fragmentary side view of the attenuator of FIG. 4 illustrating a structure for attaching the device to an object.

FIGS. 3–5 show a second embodiment of the present invention. As shown in FIGS. 3 and 4, a resilient housing 40, is generally rectangular in cross section, and has a jacket portion 53 and at least one rigid end portion 54 which is affixed to the apparatus similarly to rigid end portions 26 of FIGS. 1 and 2. Jacket portion 53 comprises parallel sidewalls 42 and 44 and top and bottom U-shaped portions 46 and 48, which are attached at their leg portions to the inner surface of sidewalls 42 and 44. Top and bottom U-shaped members 46 and 48 form upper and lower parallel walls, respectively, of jacket portion 53. Jacket 53 is preferably formed of material such as steel, fiberglass or glass reinforced plastic.

FIGS. 3 and 5 show one rigid end portion 54 of resilient housing 40 for attaching apparatus 20 to a submerged surface. Rigid end portion 54 is a solid, six-sided, box-shaped member which is rectangular in cross section and abuts at least one end of jacket portion 53. Rigid end portion 54 is composed of material similar to that of jacket portion 53. If a rigid end portion 54 is used at only one end of jacket portion 53, the second end of resilient housing 40 is preferably closed by a plate (not shown) of material similar to that of jacket portion 53 or end portion 54. End portion 54 preferably includes a plurality of openings 126 for attachment means or bolts 128. Openings 126 extend from a top surface 130 of rigid end portion 54 through a bottom surface 132 of rigid end portion 54 and are shaped to conform to attachment means or bolts 128.

Resilient housing 40 also includes a resilient portion 41 extending between the leg portions of bottom U-shaped portion 48 and abutting the interior of the bight of bottom U-shaped portion 48. Resilient portion 41 is composed of materials similar to those used in resilient portion 24 of FIGS. 1 and 2.

In FIG. 4, housing 40 has a first rectangular void 50, which is enclosed by resilient portion 41 on at least four sides, and a second rectangular void 52. Second void 52 is defined on a first side 43 by an interior wall 55 of the bight of top U-shaped portion 46. Second and third sides 45 and 47 of second void 52 are defined partly by inner surface 56 of parallel sidewall 42 and by inner surface 58 of parallel sidewall 44, respectively. Inner surfaces 56 and 58 define a lower portion of second and third sides 45 and 47 of second void 52, respectively. An upper portion of second and third sides 45 and 47 of second void 52 are defined by the leg portions of top U-shaped portion 46 which extend downwardly for approximately half the length of second and third sides 45 and 47 of second void 52, their outer surfaces being in contact with inner surfaces 56 and 58 of parallel sidewalls 42 and 44. A fourth side 49 of second void 52 is defined by a top surface 59 of resilient portion 41 and by the upper end surfaces of bottom U-shaped portion 48.

Figure 6:
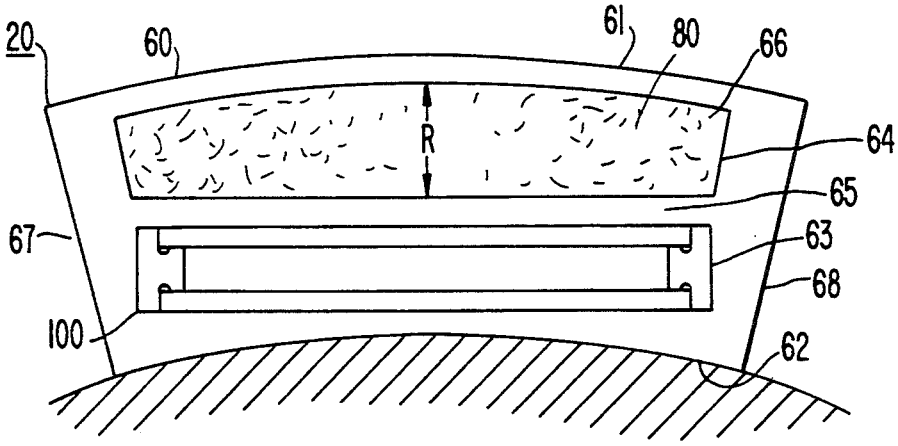
FIG. 6 is a cross-sectional view of a third embodiment of an attenuator incorporating the teachings of the present invention.

FIG. 6 shows a cross-sectional view of a third embodiment of the present invention. In FIG. 6, a resilient housing 60 has disposed therein a first rectangular void 63 and a second void 64. Resilient housing 60 also has a top curved surface 61 and a bottom curved surface 62. First void 63 and second void 64 are separated by a wall or septum 65 integral with resilient housing 60 and extending substantially parallel to a line tangent to a center point of top curved surface 61. In the embodiment of FIG. 6, first void 63 is disposed adjacent bottom curved surface 62 and second void 64 is disposed adjacent top curved surface 61. In addition, a top side 66 of second void 64 is curved to conform to the curvature of top curved surface 61. In FIG. 6, device 20 is attached to a convexly shaped surface to attenuate sound waves approaching device 20 from a direction from which they first contact top curved surface 61. This convexly shaped surface may be, for example, an outer hull of a submarine.

Figure 7:
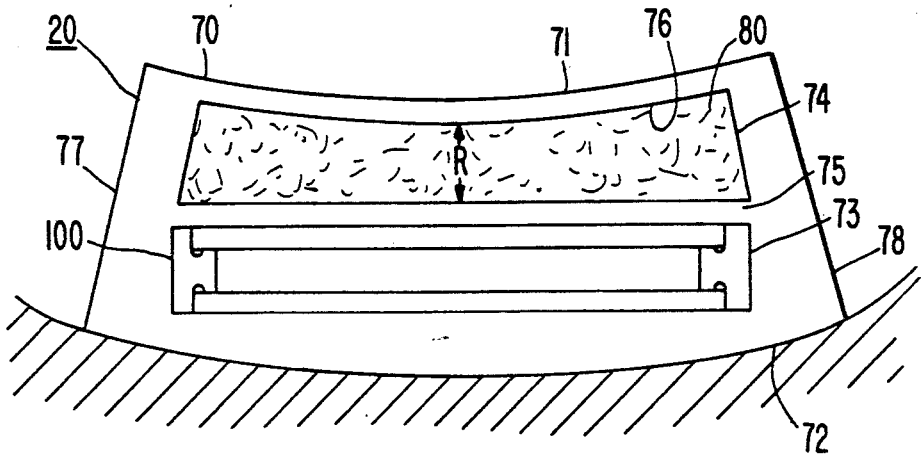
FIG. 7 is a cross-sectional view of a fourth embodiment of an attenuator incorporating the teachings of the present invention.

FIG. 7 shows a cross-sectional view of a fourth embodiment of the present invention. In FIG. 7, a resilient housing 70 has disposed therein a first rectangular void 73 and a second void 74. Resilient housing 70 also has a top curved surface 71 and a bottom curved surface 72. First void 73 and second void 74 are separated by a wall or septum 75 integral with the housing 70 and extending substantially parallel to a line tangent to a center point of bottom curved surface 72. In the embodiment of FIG. 7, first void 73 is disposed adjacent bottom curved surface 72 and second void 74 is disposed adjacent top curved surface 71. In addition, a top side 76 of second void 74 is curved to conform to the curvature of top curved surface 71. In FIG. 7, device 20 is attached to a concavely shaped surface to attenuate sound waves approaching device 20 from a direction from which they first contact top curved surface 71. This concavely shaped surface may be, for example, an inner hull of a submarine.

As embodied in Figs. 6 and 7, resilient housings 60 and 70 are made of material similar to the material of resilient housing 22 of FIGS. 1 and 2, having parallel arcuate upper and lower surfaces 61 and 62, and 71 and 72, respectively, and radially extending side surfaces 67 and 68, and 77 and 78, respectively. Such a configuration permits a plurality of such housings to be positioned contiguous to one another at their side surfaces for attachment to an object having a similarly curved surface.

Figure 8:
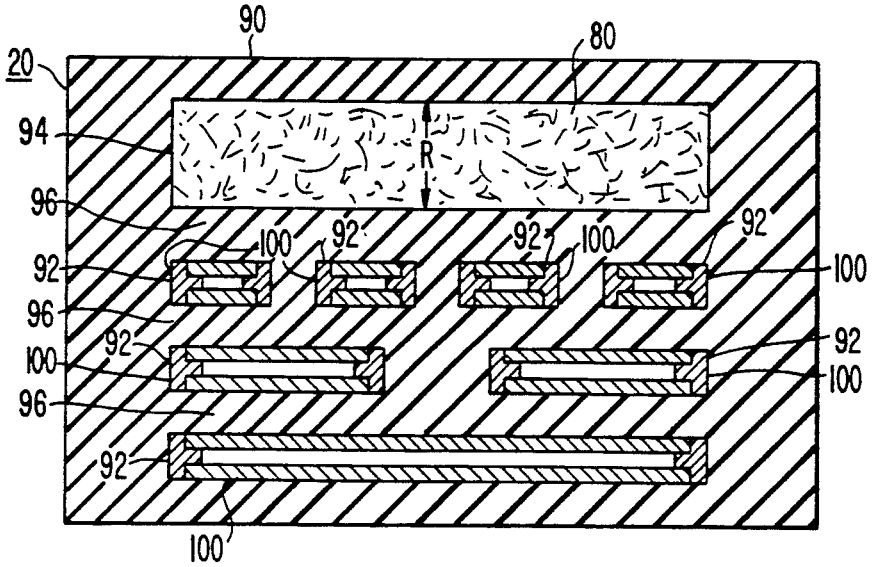
FIG. 8 is a cross-sectional view of a fifth embodiment of an attenuator incorporating the teachings of the present invention.

FIG. 8 shows a cross-sectional view of a fifth embodiment of the present invention. In FIG. 8, a resilient housing 90 has disposed therein a plurality of voids 92, which are similar to first voids 32, 50, 63, and 73 of FIGS. 2, 4, 6, and 7, respectively. Resilient housing 90 also has a second void 94 disposed therein. Plurality of voids 92 and second void 94 are separated by wall or septum portions 96 of resilient housing 90.

Figure 9:
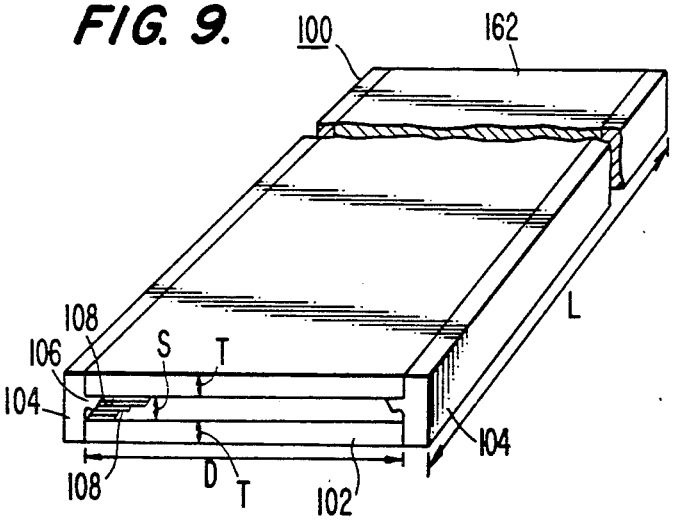
FIG. 9 is a view in perspective of a compliant tube used in the attenuator of the present invention.

In accordance with the present invention, the apparatus comprises a compliant tube disposed in the first void. As embodied herein and shown in FIGS. 2, and 4–8, first voids 32, 50, 63, and 73 and plurality of voids 92 contain a hollow, rectangular tube-shaped structure or compliant tube 100. As shown in FIG. 9, compliant tube 100 includes two free-bending, edge supported or hinged spans 102. Each span 102 is formed of a flat metal plate of thickness "T", free-bending with length "L", and width "D". The hinged spans are preferably fabricated using any high elastic modulus material with good flexural characteristics such as 4130 steel or 4340 steel or a fiber-reinforced, plastic laminate. The spans 102 should at a minimum have a flexural strength of 200,000 psi and a minimum elastic modulus of $20\times106$ psi. The flexural strength of each span exceeds the flexural stress when loaded and the spans are touching each other, and the elastic yield point of each span is higher than the strain imposed by deflection during operation.

Figure 10:
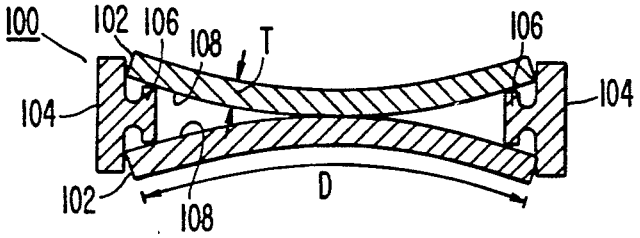
FIG. 10 is a cross-sectional view of the compliant tube of FIG. 9 showing the spans in a deflected state.

The spans 102 are hinged, i.e., retained in a free-bending manner such that upon loading they deflect freely perpendicular to their planes. This deflection causes the spans to rotate around their supportive edge fulcrums and thus act as if hinged. This specific method of support enables the attainment of the low "natural" frequency of vibration required with a unit of practical size and capable of withstanding the high external pressure encountered in the sea at great depths. In the embodiments shown in FIGS. 1–8, this hinging of the spans 102 is accomplished by use of two elongated edge members 104 having substantially T-shaped cross sections which support the two spans along their length "L". As shown in FIG. 10, each edge member 104 has a flange 106 that projects inwardly and contacts and supports the longitudinal, inner edges 108 of both spans 102. Thus, as shown in FIG. 10, for example, flange 106 of each T-shaped edge member 104 separates the oppositely disposed, inwardly facing planar surfaces 108 of opposed spans 102. The height of the area between the spans 102 is defined by the thickness of flange 106 of T-Shaped edge members 104 and is denoted as "S."

Thus, the entire inner edges of each span 102 rest freely on one of the two flat sides of flange 106 of the edge members 104. The entire edge face of each span 102 abuts against one of the two underside surfaces of edge members 104. Operation of a compliant tube such as compliant tube 100 is described in the parent U.S. patent application Ser. No. 739,513 of Charles B. Kurz, filed May 31, 1985 now U.S. Pat. No. 4,815,050, and referenced herein.

Figure 11:
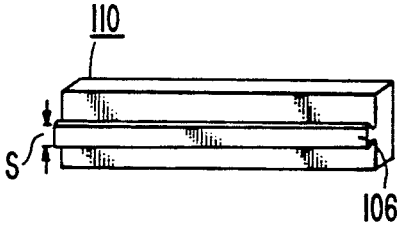
FIG. 11 is a view in perspective of an end member of the tube of FIG. 9.

Compliant tube 100 may also include end members or caps which close each end of the tubular structure 100. One such end member 110 is shown in FIG. 11. End members 110 are of the same cross-sectional T-shape as the two edge members 104 and thus also include a flange 106 of thickness "S" which projects inwardly and contacts and supports the spans 102 adjacent their inner end edges. Extrusion is the preferred method of generating the shape of these end and edge members 104 and 110 which can then be cut to the desired lengths. It is understood that prior to assembly, the edges of these end members 110 could be mitered so that they fit snuggly at the corners of the opposed spans 102 if the corners of the opposed spans 102 are also mitered.

Figure 12:
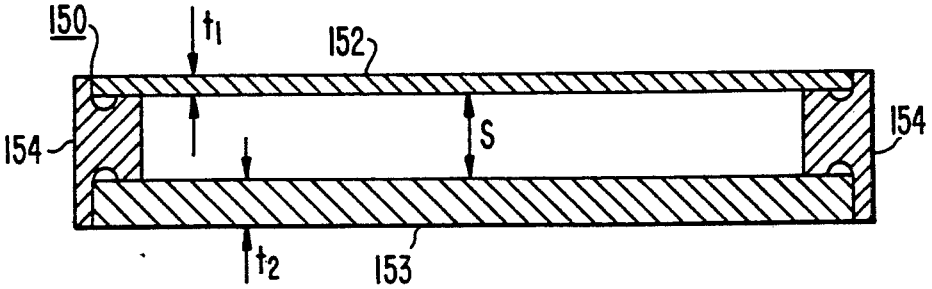
FIG. 12 is a cross-sectional view of a second compliant tube that may be used in the attenuator of the present invention.

FIG. 12 shows a compliant tube 150 of the present invention in which the free-bending spans 152 and 153 are of different thicknesses, $t_1$ and $t_2$, respectively. Because of this difference in thicknesses, the edge members 154 supporting these two spans have offset flanges as shown. The purpose of this hybrid compliant tube is to broaden or expand the frequency range of attenuation beyond that resulting when two spans of equal thickness are employed. The distance "S" separating the spans is the total of the deflection of both spans at a pressure somewhat greater than that occurring at the maximum operating depth of the device.

FIG. 8, as described above, shows a cross-sectional view of a fifth embodiment of the present invention, having an array of compliant tubes of varying sizes, each constructed in accordance with the teachings of the present invention. Each of the compliant tubes 100 is constructed as in FIGS. 9–10, although the array could be comprised of other types of compliant tubes such as the type in FIG. 12 or could have an end member such as end member 110 of FIG. 11. The use of an array of different sized compliant tubes as depicted in FIG. 8 gives an expanded range of frequencies that can be attenuated.

In accordance with the present invention, the apparatus comprises fluid means disposed in the second void. As shown in FIGS. 2, 4, and 6–8, second voids 33, 52, 64, 74, and 94 of the present invention contain a fluid means 80 for dissipating sound waves striking the resilient housing. Fluid means 80 preferably is composed of a viscous liquid and metal fibers. The viscous liquid preferably is oil of a consistent viscosity, such as 1000 centistokes silicone oil. The metal fibers preferably have a diameter of 0.010 inches and are 0.5 inches in length, packed to a bulk density of at least 15 percent (i.e., the viscous liquid 82 occupies at most 85 percent of the second voids 33, 52, 64, 74, and 94 and the metal fibers occupy at least 15 percent of the second voids.) Fluid means 80 serves a sound dissipative function within the voids 33, 52, 64, 74, and 94. The metal fibers act to stabilize the viscous liquid with the void. The depth of these voids, R, required to dissipate sound energy effectively depends on the wavelength of the sound to be dissipated, which, in turn, is directly proportional to the velocity of the sound in the medium and inversely proportional to the frequency of the sound. The presence of the compliant tube 100 decreases the velocity of sound traversing the fluid means 80 adjacent to the compliant tube. This decreased velocity decreases the wavelength of the sound waves traveling through the fluid means 80 and, thus, decreases the depth R of the medium required to dissipate sound energy.

Thus, compliant tube 100 and fluid means 80 have a synergistic effect on sound waves passing through apparatus 20. Fluid means 80 acting alone, for example, would not attenuate sound waves effectively since the depth, R, of fluid means 80 is insufficient for such a purpose. The combination, however, of fluid means 80 and of compliant tube 100 attenuates sound more efficiently and at lower frequencies than would either component alone.

In addition to being thin and pressure resistant, the present invention also acts as a decoupler against sound emanating from a noise source adjacent the side of the present invention nearest compliant tube 100. For example, the present invention as shown in FIG. 6, applied to the outer hull of a submarine would serve the dual role of preventing incident sound (i.e., sound from active sonar) from being reflected and of preventing the ship's own sound from radiating outward.

It will be apparent to those skilled in the art that various modifications and variations could be made in the invention without departing from the scope or spirit of the invention. Thus, it is intended that the present invention cover the modifications and variations of this invention, provided such modifications and variations come within the scope of the appended claims and their equivalents.

What is claimed is:

1. An apparatus for attenuating low frequency sound striking a submerged surface comprising:

a housing having a plurality of first voids and at least one second void therein, said at least one second void being fewer in number than said plurality of voids;

a compliant tube disposed in each of said plurality of first voids for decreasing the sound velocity and having a pair of free-bending spans spaced a preselected distance opposing and separate from each other during an unflexed state, which means supporting said spans adjacent their peripheral edges; and fluid means including a mixture of liquid and fibers, said fibers suspended in the liquid disposed in said at least one second void for dissipating sound waves of decreased velocity from the plurality of first voids traversing the mixture, said fibers having a bulk density of at least approximately 15% of the mixture.

2. The apparatus of claim 1, wherein said housing includes a resilient portion for enclosing each of said plurality of first voids.

3. The apparatus of claim 1, wherein said housing includes a wall for separating said first and second voids.

4. The apparatus of claim 1 wherein said housing includes elastomeric material.

5. The apparatus of claim 1, wherein each said compliant tube comprises a pair of substantially T-shaped edge members, each of said edge members having an inwardly projecting flange and wherein each said span has an inwardly facing planar surface, and further wherein both of said inwardly facing planar surfaces of said spans are contacted and supported by said flanges of said T-shaped edge members which separate said spaced spans during the unflexed state of said spans.

6. The apparatus of claim 1 wherein said free-bending spans are of different thicknesses.

7. The apparatus of claim 1 wherein said housing includes means for attaching an exterior surface of the apparatus to the submerged surface.

8. An apparatus for attenuating low frequency sound striking a curved submerged surface comprising:

a housing having first and second voids therein, wherein said housing has at least one curved inner surface for conforming to a similarly curved submerged surface and having an outer curved surface, said first void being disposed adjacent to the inner curved surface, said second void being disposed adjacent the outer curved surface and having a curved wall adjacent to and conforming to the outer curved surface;

a compliant tube disposed in said first void for decreasing the velocity of sound and having a pair of free-bending spans spaced a pre-selected distance opposing and separate from each other during an unflexed state, with means supporting said spans adjacent said peripheral edges, said first void and said second void being separated by a wall extending tangent to at least one of the curved inner surface and the curved submerged surface; and fluid means including a viscous liquid and fibers suspended in the viscous liquid disposed in said second void for dissipating the sound waves of decreased velocity traversing the second void, said fibers having a bulk density of at least approximately 15% of the total viscous liquid and fibers.

9. The apparatus of claim 8, wherein said housing includes a wall for separating said first and second voids.

10. The apparatus of claim 8 wherein said housing includes elastomeric material.

11. The apparatus of claim 8 wherein said fluid means comprises a mixture of viscous liquid and metal fibers suspended in the liquid.

12. The apparatus of claim 8, wherein said span-supporting means comprises a pair of substantially T-shaped edge members, each of said edge members having an inwardly projecting flange and wherein each said span has an inwardly facing planar surface, and further wherein both of said inwardly facing planar surfaces of said spans are contacted and supported by said flanges of said T-shaped edge members which separate said oppositely disposed spans during the unflexed state of said spans.

13. The apparatus of claim 8 wherein said free-bending spans are of different thicknesses.

14. The apparatus of claim 8 wherein said housing includes means for attaching an exterior surface of the apparatus to the submerged surface.

15. An apparatus for attenuating low frequency sound striking a submerged surface comprising:

a housing having a plurality of first voids and a second void therein;

a plurality of compliant tubes for decreasing the velocity of sound, each compliant tube disposed in a corresponding one of said first voids and each compliant tube having a pair of free-bending spans spaced a pre-selected distance opposing and separate from each other during an unflexed state with means supporting said spans adjacent their peripheral edges; and fluid means including a mixture of fibers and viscous liquid, said fibers suspended in the viscous liquid disposed in said second void for dissipating sound waves of decreased velocity traversing the second void, said fibers having a bulk density of at least approximately 15% of the mixture.

16. The apparatus of claim 15, wherein said housing includes a wall for separating said plurality of first voids from said second void.

17. The apparatus of claim 15 wherein said housing includes elastomeric material.

18. The apparatus of claim 15 wherein said fluid means comprises a mixture of viscous liquid and metal fibers.

19. The apparatus of claim 15, wherein said span-supporting means comprises a pair of substantially T-shaped edge members, each of said edge members having an inwardly projecting flange, and wherein each said span has an inwardly facing planar surface, and further wherein both of said inwardly facing planar surfaces of said spans are contacted and supported by said flanges of said T-shaped edge members which separate said oppositely disposed spans during the unflexed state of said spans.

20. The apparatus of claim 15 wherein said free-bending spans are of different thicknesses.

21. The apparatus of claim 15 wherein said housing includes means for attaching an exterior surface of the apparatus to the submerged surface.

22. A method for attenuating low frequency sound striking a submerged surface, comprising:

providing a housing having a surface for engagement with the submerged surface and having an outer surface;

providing at least one void adjacent the outer surface and a plurality of spaced voids greater in number than the at least one void spaced from and between the at least one void and the engagement surface of the housing;

placing a compliant tube in each of said plurality of voids for decreasing the velocity of the sound;

said fibers having a bulk density of at least approximately 15% of the mixture; and providing in the at least one void a mixture of viscous liquid and fibers, the fibers being suspended in the liquid for dissipating the sound said compliant tube having a pair of free-bending spans spaced a pre-selected distance opposing and separate from each other during an unflexed state, with means supporting said spans adjacent their peripheral edges;

23. The method of claim 22 wherein the step of providing the mixture includes providing a mixture of metal fibers and viscous liquid.

24. The apparatus of claim 1 wherein said fluid means comprises a mixture of viscous liquid and metal fibers.

* * * * *

UNITED STATES PATENT AND TRADEMARK OFFICE

CERTIFICATE OF CORRECTION

PATENT NO. : 5,138,588

DATED : August 11, 1992

INVENTOR(S) : Chuan et al.

It is certified that error appears in the above-identified patent and that said Letters Patent is hereby corrected as shown below:

IN THE CLAIMS

Claim 1, column 8, line 14, "which" should read --with--.

Claim 15, column 9, line 30, after "therein" insert --at least a portion of the housing defining the first voids being resilient--;

Claim 15, column 9, lines 35-36, "opposing and separate from" should read --opposite--.

Claim 22, column 10, line 32, after "sound" insert --said compliant tube having a pair of free-bending spands spaced a pre-selected distance opposing and separate from each other during an unflexed state, with means supporting said spans adjacent their peripheral edges--;

Claim 22, column 10, lines 33-34, delete in their entirety;

Claim 22, column 10, lines 37-41, delete and insert therefor --liquid for dissipating the sound, said fibers having a bulk density of approximately 15% of the mixture.--.

Signed and Sealed this

Eighteenth Day of January, 1994

Attest:

Bruce Lehman

BRUCE LEHMAN

Attesting Officer

Commissioner of Patents and Trademarks